US006575464B1

(12) United States Patent
Fertitta et al.

(10) Patent No.: US 6,575,464 B1
(45) Date of Patent: Jun. 10, 2003

(54) PLAYING CARD POKER GAME WITH OPPORTUNITY TO BET WITH "THE HOUSE"

(76) Inventors: Dominick Fertitta, 25-35 208th St., Bayside, NY (US) 11260; Salvatore Fertitta, Jr., 890 West Gate, N. Valley Stream, NY (US) 11580

( * ) Notice: Subject to any disclaimer, the term of this patent is extended or adjusted under 35 U.S.C. 154(b) by 3 days.

(21) Appl. No.: 10/054,344

(22) Filed: Nov. 13, 2001

(51) Int. Cl.[7] ..... A63F 1/00
(52) U.S. Cl. ..... 273/274; 273/292
(58) Field of Search ..... 273/274, 292, 273/309

(56) References Cited

U.S. PATENT DOCUMENTS 5,275,416 A * 1/1994 Schorr et al. ..... 273/292
5,863,042 A * 1/1999 Lo ..... 273/292
5,868,392 A * 2/1999 Kraft ..... 273/292
5,876,283 A * 3/1999 Parra et al. ..... 463/12
5,957,459 A * 9/1999 Chae ..... 273/292
6,062,979 A * 5/2000 Inoue ..... 463/12
6,079,712 A * 6/2000 Eaton et al. ..... 273/274
6,095,525 A * 8/2000 Terminel ..... 273/274
6,237,916 B1 * 5/2001 Webb ..... 273/292
6,241,250 B1 * 6/2001 Webb ..... 273/292
6,279,910 B1 * 8/2001 de Keller ..... 273/292
6,299,171 B1 * 10/2001 Mollo et al. ..... 273/292
6,299,533 B1 * 10/2001 Parra et al. ..... 463/17
6,302,396 B1 * 10/2001 Eaton et al. ..... 273/274
6,345,823 B1 * 2/2002 Webb ..... 273/292
6,402,147 B1 * 6/2002 Lo ..... 273/292
6,488,284 B2 * 12/2002 Webb ..... 273/274

* cited by examiner

*Primary Examiner*—William M. Pierce
(74) *Attorney, Agent, or Firm*—Levisohn, Lerner, Berger & Langsam LLP

(57) ABSTRACT

A method and apparatus for playing a casino card game for one or more wagering players betting with or against the "house" or casino comprising three card stud poker in which the player(s) seek a high hand, ideally either, at least, a pair of 3s or better, and in increasing desirability, a flush, a straight, 3 of a kind, a straight flush or royal flush from one or more shuffled standard playing card deck(s) (52 playing cards per deck). The wagering aspect of the game involves each player placing two mandatory bets, one wager on the possibility of the three card deal to the player showing a pair of "Threes or Better" and one wager on whether the "Player" or the "House" will be dealt the ranked, superior 3 card stud poker hand. In addition, optional wagers may be placed by each player, all before any cards are dealt, on the possibility of a tie game, i.e., the dealt three card poker hand of the player exactly matching in rank the dealt three card poker hand of the dealer (a "Tie-Bet")(for which the player would receive a payoff if that occurs) and a separate Jackpot bet (paying the player a predetermined, relatively large payout; preferably 1000:1) if the dealt three card hand of the player is exactly a predetermined ranking or a specified set of three cards, preferably, the two black Aces (Spades and Clubs) and the Ace of Hearts (a "Dingo® Jackpot").

14 Claims, 2 Drawing Sheets

PLAYING CARD POKER GAME WITH OPPORTUNITY TO BET WITH "THE HOUSE"

GENERAL BACKGROUND OF THE INVENTION

Casino playing-card gambling games are well known. A successful playing-card game, for the casino, is one which, of course, generates revenue to the casino. That, however, requires that the game be interesting enough to potential gamblers that they perceive the game to be worthy of their time and money wagered. The game should be quick and utilize standard and recognizable rules of card playing. The resolution of the wagers should also be quick and easily understood. Large payoffs (in frequency and/or amounts) should lead to increased patron interest. Over time, then, while some players may "win" over the short time they play the game, the casino knows that it will generate revenue, when all players are considered, so long as the "odds" of winning are carefully set by the casino in accordance with well-known card occurrence, probabilities. The present invention is intended to provide an interesting card game for players, allowing them to make decisions on wagering on the possibility of certain three card poker hands being dealt to them and to the dealer. The casino can set the payoffs (in frequency and amounts) to provide the casino with a source of revenue.

The present invention relates to casino gambling by use of a playing-card game with players (one or more) wagering on a three card, stud poker, no draw playing card game. The card game can have one or more players who bet or wager and hope to win money from the casino based on the amount of money wagered on each dealt hand. Before the cards are dealt the dealer calls for all wagers to be made. The players each must place two mandatory bets and can optionally place one or two additional bets on the outcome of the dealt hands. The first mandatory bet by the player is on the possibility that the three cards dealt to the player equals or exceeds a predetermined ranking of three card poker hands. According to the preferred embodiment of the invention, the first bet by the player(s) is whether the dealt cards to the player equals or exceeds the ranking of a pair of threes in a three card poker hand. The next mandatory bet is on the possibility that the player's three card poker hand ranking exceeds or is beaten by the dealer's ranked three card poker hand. An optional wager may be placed on the possibility that the player's ranked hand and that of the dealer are the same, i.e., a tie. Another optional wager which can be placed by the player is on the possibility that the player's hand is an exact ranked hand or an exact three dealt cards.

After wagering by the players, the players and dealer are each dealt (by the dealer) three cards from a shuffled deck or multiple decks of standard playing cards (each deck with 52 cards). The dealer and player then turn over their "hands" of dealt cards and compare the player's hand against the hand of the dealer, "house" or casino and, in addition, against a listing of ranked three-card poker hands. Depending upon the dealt cards to the player(s) and the casino, the dealer (representing the casino) pays off (i.e., resolves the wagers) in proportion to the amount wagered on the mandatory two bets and the one or two optional bets or takes the player's bet, if the casino "wins" the bet.

The game is intended to be interesting to the player in terms of the payoffs and options presented, simple to understand, and, yet, quick in terms of the time required for the placement of bets, cards dealt and bets resolved. The game is intended to captivate the player's interest and the interest of onlookers who may become new players so that the casino can generate funds from casino guests. In addition, the potential payoffs (in frequency and odds) and manner of wagering are sufficiently high and diverse, respectively, that a player's interest will be maintained. Over time, of course, assuming the casino has properly set the payoff amounts, the casino will generate a positive source of revenue from players.

BRIEF DESCRIPTION OF THE INVENTION AND FURTHER BACKGROUND

The present invention relates to wagering games. In particular, it relates to a method for playing a three card poker-like casino game. To the inventors' knowledge, there are no casino wagering card-based games which allow for a three card hand of stud poker (i.e., no card is replaced by a drawn card) to be played where the player is provided with the option of wagering on the possibility of a tie outcome between the hand of the casino and the player nor are there three card casino, stud poker games where a player may place bets on either his hand or the house having the superior ranked three card poker hand.

There are many wagering games used in casino gambling. Many are based on standard playing cards, i.e., 52 cards—four suits with each suit having 13 cards, 2–10, a Jack, Queen, King and an Ace. Many of these games use multiple decks. All such games, for the benefit of the casino, should be exciting and arouse the player's interest (both with the options to be played and with the payouts compared to the amounts wagered) and relatively uncomplicated so they can be understood easily by a large number of players and onlookers (potential players to the casino). Furthermore, the wagering game should keep a player from switching to another, "hotter" table at the time his dealer seems to be getting a better "luck of the draw." The present invention by allowing a player to selectively wager on the "dealer" having the superior ranked three-card poker hand in comparison to the dealt hand to the player, satisfies this.

Wagering games, particularly those intended for play in casinos, should provide players with a sense of participation, the opportunity to make decisions, and reasonable odds of winning, even though the odds favor the casino, house, dealer, or banker. The game must also meet the requirements of regulatory agencies. The present invention satisfies all of these criteria.

The "Three Card Poker" game described in U.S. Pat. No. 6,237,916 involves dealing three cards to the dealer and to the player and includes a special optional bet for a bonus payout if a player receives a preselected ranking in his hand (pairs or better). Differing from the presently disclosed and inventive game, however, the patented Three Card Poker does not contain the option or equivalent of a bonus payout for a "Tie Bet" or the ability of the player to shift from betting on himself to the dealer or house. Furthermore, in the '916 patented 'Three Card Poker" game, the player's second bet of pairs or better is optional rather than mandatory.

Even more significantly, however, the description and claims of the '916 patent recite that the player is provided with the ability to place an additional wager (a third wager) after looking at his hand such that the hands are compared (player to dealer) only if the third "Play" wager is placed (and the house or dealer wins depending on which hand is better) or the player forfeits at least his ante if the third "Play" bet is not placed. The present invention does not provide for the possibility of the player increasing the amount wagered after the player views his hand. Elimination of this optional bet should promote speed of the game. That, of course, is desirable to casino and to players.

Similarly, U.S. Pat. No. 5,685,774 entitled: Method of Playing Card Games allows the player to place an optional ranking type bet (pairs or better, for example) and after looking at his cards placing an optional "Play" bet against the dealer which, if not placed, forfeits the Player's ante bet. The patent states: "each player who places the second bet (the ante bet) deciding, based on the player's hand, either to forfeit the second bet to the banker or to place a third bet" (the Play bet against the Dealer's hand). The present invention does not provide this optional Play wager, after the cards are viewed by the player. While the present game is a three card poker-based casino game, it does not allow the player to wager after receiving his hand. There is no decision to the Player such that if he refuses to further wager he is forfeiting his initial ante wager. This, again, leads to a quicker and more interesting game.

U.S. Pat. No. 5,544,892 is also prior art to the present invention. It is a variation of 5 card, no draw poker where the players are provided with 3 cards and the dealer with 2 cards. The player's use the dealer's cards to form his or her five card poker style hand and play, therefore, not against the dealer but to achieve certain ranked hands to obtain large payouts. This is distinct from the present invention which contemplates the player obtaining a 3 card poker-like hand and the dealer also obtaining a three card poker hand.

U.S. Pat. No. 6,019,374 issued Feb. 1, 2000 to Shuffle Master, Inc. The game described in the '374 patent includes as a step for a method of playing a series of games that a second game is played to select a winner of a jackpot from an accumulation of players eligible to win the jackpot. Thus, a second separate game is played for determining which of the players, previously achieving a certain level by playing a first game, is entitled to win the jackpot. The game of the present invention does not contemplate a second game by a series of qualified players to determine the winner of a large jackpot. However, a large jackpot is available, if an amount is wagered, and the three cards dealt to the player who has wagered equal or exceed either a ranked three card poker hand or are three identical cards to that predetermined by the casino, e.g., the two Black Aces (Clubs and Spades) and the Ace of Hearts. Furthermore the '374 patent does not teach nor suggest either a Tie-Bet or the possibility of betting on the dealer's hand as exceeding that of the player's dealt hand.

U.S. Pat. No. 5,657,993 entitled: Method of Playing a Poker-Type Wagering Game is also interesting and generally related to the subject matter of the present invention. That patent relates to the concept of dealing a pair of cards to each betting participant, face down, and the "house" being dealt three cards also face down which are selectively "rolled". Then, the combined five card stud poker hands (two cards of each player and the three house cards) are viewed with the highest stud poker hand winning. Thus, players play against one another and not against the house. The present invention does not deal only two cards to each player nor does it provide three "community" cards to be combined with the players pair of cards to produce a five card stud poker hand.

U.S. Pat. No. 6,131,907 issued Oct. 17, 2000 is for a game involving five card stud poker. After five cards are dealt to the player (the player has an opportunity to forfeit his prior bet if he chooses not to continue the game after the third card is dealt and viewed) each five card completed hand is compared to a predetermined ranking of hands such that if the player's hand does not achieve a minimum predetermined rank then the bet is lost or if the player's five card hand exceeds the predetermined ranking of hands then the dealer pays according to predetermined odds based upon the achieved predetermined rank. The present game contemplates the distribution of three cards to each betting player and contemplates a comparison of each player's hand to the house or dealer's hand for determination of one of the bets. The '907 patent neither teaches nor suggests a Tie-Bet, the opportunity for the player to bet on the dealer's hand exceeding the hand dealt to the player, nor a Jackpot bet and corresponding payoff on the possibility of three exact predetermined playing cards being dealt to the player.

U.S. Pat. No. 5,845,907 issued Dec. 8, 1998 relates to a method of playing a poker variation card game wherein the dealer provides each betting player with face down cards and there is at least one "community" or common card, originally face down, for use by all participating players. The present invention contemplates no community card for the player's to use in forming their three card stud poker hand.

U.S. Pat. No. 5,324,041 entitled High Card Wagering Game, issued Jun. 28, 1994 and relates to a method of playing a betting game wherein each player is provided with only one card which is then compared to the dealer card and if the player's card exceeds that of the dealer, paying off on a bet but if there is a tie then a further bet is made and resolved on the basis of the next set of individual cards dealt to both player and dealer. There is no teaching in the '041 game of the Player betting on the possibility of a Tie, nor is there a teaching of the possibility of the player betting on the dealer's hand exceeding that of the player's. There is also no teaching of betting by the player on the possibility that the three cards dealt are three exact (of the 52) predetermined cards for a Jackpot payoff.

The following are believed distinctive and characterizing features of the present invention, either when the prior art is individually considered or even if combined together with one another:

(a) The opportunity for the player to bet on the "house" rather than on his hand such that if the dealer's hand surpasses that of the player in a three card poker game, then the player nevertheless wins a payoff based on his wager. This aspect of the game, i.e., the ability to bet on the house rather than always with the player allows the player to continue to play although the player believes that the dealer is "hot" or on a winning streak. In the absence of this feature, the player might consider leaving the table or game.

(b) An opportunity to place an optional wager such that if an actual tie is obtained between the ranking of the player's three card poker hand and the dealer's hand, then a large payout is provided to the player, based on the amount so wagered, to the extent the player has bet on a "tie." Usually, tie hands (as in the game of 21 or Blackjack) yield a win for the casino or dealer. Oftentimes, in casinos, a "tie" of a wagering game results in a "push" i.e., a game of no consequence with the player being able to decide between playing a new game with the original ante bet or taking up the bet and walking away from the game. Here, however, the player can bet on the possibility of a tie occurring and if it does occur, then a large payout is obtained for the player.

(c) An opportunity to make a second optional wager on a precise predetermined "jackpot hand" being dealt to the player which is comprised of three cards. If the three cards equal or exceed a predetermined ranking of three card poker hands then the jackpot is distributed to the player. Alternatively, the jackpot hand can be won only if the three dealt cards are identical to a predetermined set of three cards as, for example, the two Black Aces (Club and Spades) and the Ace of Hearts. No prior art game for three card casino gambling provides for this large payout dependent upon a separate optional bet.

SUMMARY OF THE INVENTION

The present invention encompasses a method and a preferred apparatus for playing the wagering game. A typical gaming table, with a playing surface, is modified to include specific areas that provide locations for placing the player(s) wagers, including the mandatory wagers on the possibility of the player obtaining a three card poker hand, without a drawer, of "Threes or Better" and on whether the "Player" or the "House" has a higher ranked three card poker hand. As will be further explained, the present invention provides other optional bets and betting areas to provide even more interest to the game and to allow the player to win and lose more money than the wagers placed on the mandatory bets. Thus, the player is also given the opportunity to bet on the possibility that the player's hand is a tie hand to the casino's ranked three card poker hand. If so and if the player has bet on that possibility, then the player wins a predetermined multiple of his wager. Also, predetermined multiples of the amounts wagered on each hand is capable of being won if the player's hand equals or exceeds a predetermined minimum of ranked three card poker hands, even if the player's hand is less than the ranked three card poker hand of the dealer. Furthermore, if the player wagers on the Jackpot bet (a Dingo® bet) and if the hand dealt to the player equals or exceeds a predetermined ranking of hands of three card poker or, preferably, is exactly the same three cards as a predetermined set, posted by the casino before the hand's are dealt (for example, preferably the two black Aces, Clubs and Spades and the Ace of Hearts) then the player wins the Jackpot, either a predetermined amount, an accumulated pot and/or a multiple of the amount wagered on the possibility of a Jackpot hand being dealt.

It is an object of the present invention to provide an exciting and interesting wagering game that is easy to learn, largely being based on poker and the well known ranking of poker hands, and in which the player has little incentive to switch to another, "hotter" table when his dealer seems to be getting a better "luck of the draw." The present invention allows the player to bet on either himself or the dealer as the three card poker hand winner. This is a distinctive characteristic of the present invention. Furthermore, as mentioned, the opportunity to bet on the possibility of a tie of hands, as between player and casino, is another distinctive characteristic of the present invention. Usually, as in Blackjack, a tie hand wins for the casino. Here the player can bet with the "house" or casino in a three card stud poker game. The player will win, too, even if his hand is a lower ranked hand than that of the dealer, if either a) he has bet on the dealer or b) even if he has bet on the player, the hand dealt to him equals or exceeds a predetermined ranking of three card hands, e.g., a pair of threes or better. Finally, there is provided the possibility of a super payoff or Jackpot paid to a player (if he placed an optional bet thereon) for the possibility of a unique three card hand being dealt to the Player. This, too, is thought to be a distinctive and characterizing feature of the present invention.

These and others aspects of the invention are thought to be novel and non-obvious over the known prior art. The invention is best understood in connection with the drawings and the detailed description of the invention and the preferred embodiment. The claims, however, define the scope of the invention.

DETAILED DESCRIPTION OF THE INVENTION AND THE PREFERRED EMBODIMENT

Figure 1:
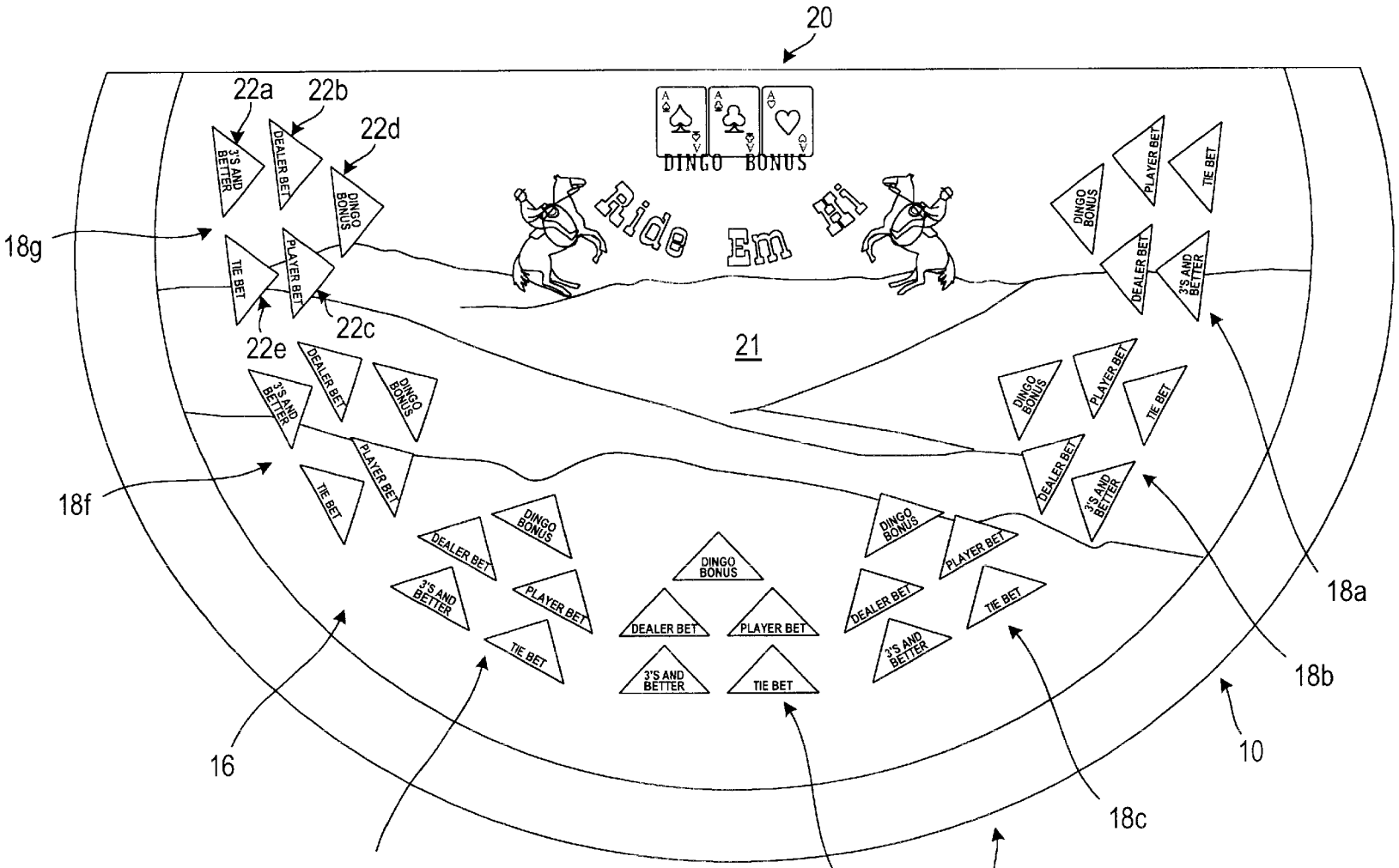
FIG. 1 depicts the table layout and apparatus preferably used in playing the wagering game of the present invention and FIG. 2 is a block diagram representing the flow of play of the game.

Referring to FIG. 1, the preferred apparatus for the wagering game of the present invention includes a typical casino gambling or gaming table 10. The table has a curved side 12 for accommodating up to seven players (although only 1 is required for the game) and a straight side 20 for accommodating the dealer, representing the interests of the casino or House. Only the dealer shuffles and deals the cards to the players and to him- or her-self. Only the dealer collects the tokens, chips or money wagered (when the player loses a bet) and makes the payoffs to the players (when the player(s) win a wager or bet). Each player's cards and wagers placed and paid off are independent of the other players. The table 10 has a flat surface 16 covered with felt or other appropriate material providing a pleasant and quiet surface for dealing and picking up cards. The felt is usually green although other colors are certainly acceptable and contemplated. The felt surface and specific material composition should be durable for allowing a large number of hands to be dealt without degradation and allow for the printing thereon of a visual enticing scene, if desired, and the game rules and payoffs of the game so that the players have immediate access and understanding. Although seven playing positions or locations 18*a–g* for individual players are provided, it is not essential to the game that exactly seven players participate for, as mentioned, a game can have only a single player and the dealer. What is important is that the dealing of the cards and the resolution of the wagers be easily, quickly and accurately managed by the dealer and house, and one in which the individual players feel involved. Thus, 7 players seems to be the ideal maximum number of players and provides for a large number of players so that each sees how other player's fare and, yet, feels fully participating in the game. A house or dealer position is central to the flat side 20 and includes an area suitable for displaying the dealer's dealt three cards 21.

Each of the seven player positions 18*a–g* includes a wagering zone 28, 27, 26, 25, 24, 23 and 22, respectively. Each wagering zone comprises four separate and distinct wagering or betting areas: a, b or c, d, and e for placing two of the mandatory bets on (i) the possibility of the player's hand having a pair of "Threes or better", i.e., a pair of threes of the standard playing card deck or a higher three card poker ranked hand, with the wager amount placed in area(a) and (ii) betting either on the Dealer, with the wagered amount placed in area (b)(signifying a "Dealer Bet") or on the Player with the wager amount placed in area (c) (signifying a "Player Bet"). Each wagering zone 22–28 has an optional "Dingo® Bonus" or Jackpot bet with the wagered amount placed in area (d) (for a Jackpot payoff if the player has bet thereon and the three dealt cards are equal to or better than a ranked set of cards or identical to a set of predetermined three cards, e.g., the two Black Aces (Clubs and Spades) and the Ace of Hearts. Additionally, there is an optional wagering area (e) "Tie Bet" on which a player may place a wager and receive a payout if there is a tie game between his dealt three cards and the dealer's dealt three cards.

Chips, tokens, or actual money may be used for wagering, in a conventional manner as presently done by casinos. The casino can restrict the maximum wagers and set the minimum wagers. The payoffs, generally, with the possible exception of the Jackpot or Dingo® bet, if desired, are proportional to the amounts wagered on the various possibilities. The wagering areas 22*a–e,* for each player position, may be designed to receive appropriate wagering indicators or settling means such as chips or tokens (not shown). In the embodiment shown in the drawing, the wagering areas are triangular but any shape may be used so long as it is apparent to dealer and player whether the player has or has not bet on the mandatory and optional bets and, if so, how much has been wagered. Players may keep their holdings, which are not subject to risk for that hand, safely behind the wagering areas (a–e) and move chips or tokens into and out of those holding areas as winnings are made and more bets for the next hand desirably placed.

Figure 2:
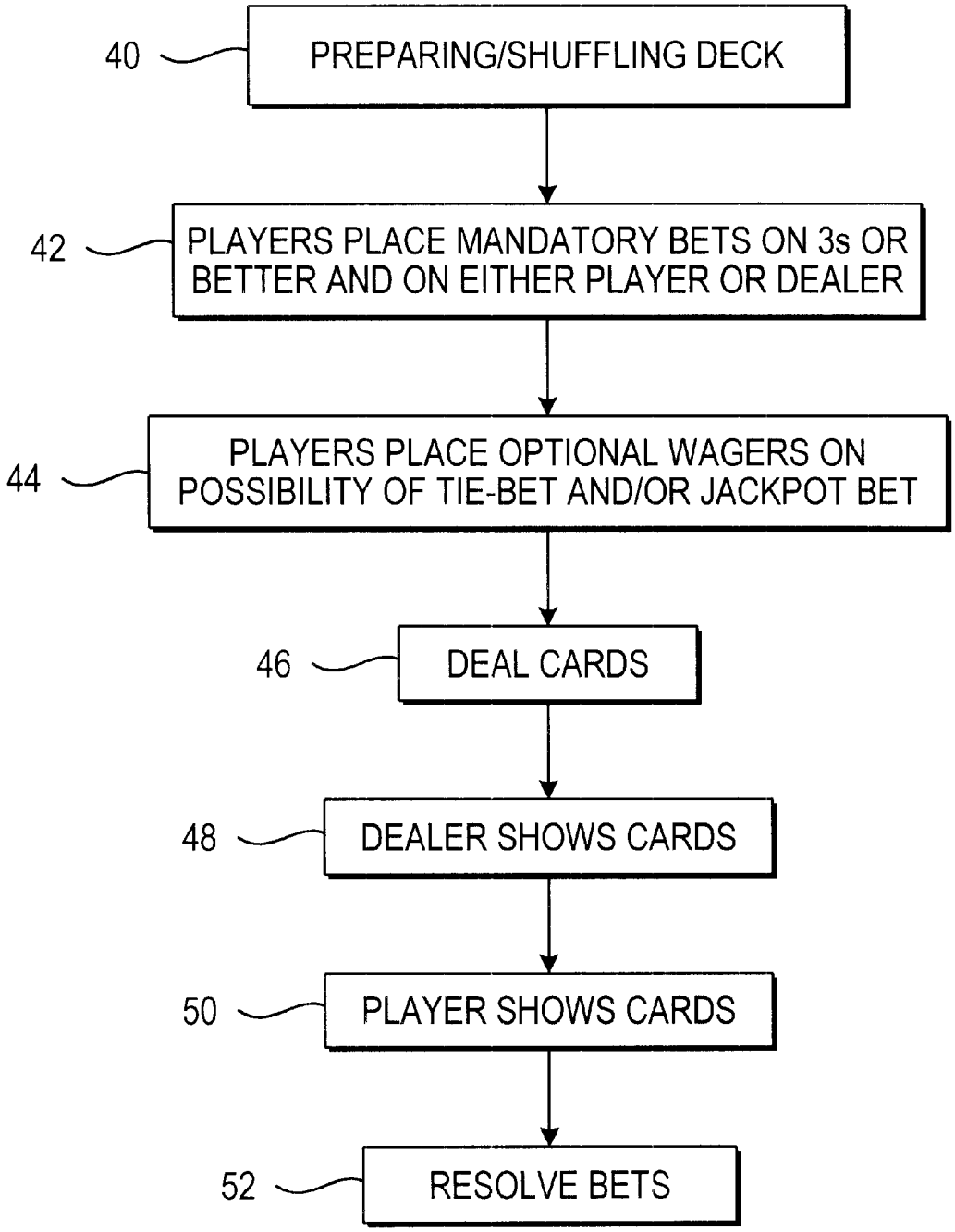

Referring to the flow diagram of FIG. 2, the initial step in playing the basic game of the present invention is preparing or shuffling a deck of cards, represented at block 40. Next, the players place an initial wager, equal to or more than the casino determined minimum and less than the casino determined maximum, at block 42, by placing mandatory wagers on 22*a* and either 22*b* or 22*c*. A first mandatory wager, for each player, is the placement of a bet on the possibility that a 3 card hand of poker dealt to the player will exceed a pair of 3s or better. This wager will be placed on the bet area 22*a* (labeled "3s or better"). A second mandatory wager must be placed by the player in either bet area 22*b* or 22*c*. This will be a bet, as between the player and the dealer (representing the casino) which of the 3 card poker hands will beat the other, i.e., a bet on the player in bet area 22*c* means that the player believes that his ranked hand will beat the rank of the dealer's hand whereas a bet on the Dealer (a bet placed in bet area 22*b*) represents the player's hope that the dealer's ranked hand, i.e., three card poker hand, upon disclosure, will beat the rank of the player's hand. As desired the casino can determine that certain bets, even the mandatory wagers, have minimums for certain minimum payoffs so, for example, the casino can determine that a player placing a bet on the dealer in bet area 22*b* (betting against the player's hand) be 6 units or a minimum or multiple of units ($6, for example) in order for the player to receive $5 if the player wins that wager, i.e., if the dealer's hand does, indeed, exceed the ranking of the player's hand. It is the preferred embodiment of the present invention that a bet on the player's hand beating the dealer's is an even money bet, i.e., for each $5 bet on the player, if the player's hand is better than the dealer, will return $5. It is presently contemplated that a bet on the 3s or better, in bet area 22*a,* provide a return as set forth in the below table. If the player's hand does not equal or exceed 3s or better, then the player's wagers in bet area 22*a* are collected by the dealer. If the player's hand, after dealing and revealing, equals or exceeds a pair of 3s or better, in ranked 3 card poker hands, then the dealer pays the player in chips, tokens or money, based on the predetermined payout schedule. As mentioned, it is desirable for the casino to post the payouts by printing the same on the felt or cloth of the table or game surface.

Optional wagers may be placed on bet areas 22*e* and/or *d.* This is indicated in FIG. 2 as box 44. These, as mentioned are for the player's belief and hope that the player's dealt hand when ranked will be a tie with the ranking of the dealer's hand (a "Tie Bet") bet area 22*e* and/or a bet by the player that a Jackpot hand (a Dingo® bet) is dealt to the player. The Jackpot bet, placed on bet area 22*d,* if wagered, is achieved if the exact or a superior rank of a predetermined hand is dealt to the player or if the player's dealt three card poker hand comprises an exact set of three cards, as predetermined and posted by the casino. Preferably, the Jackpot (or Dingo® bet) is paid to a wagering player if his hand comprises the two Black Aces (Clubs and Spades) and the Ace of Hearts. The Jackpot wager can provide for a payoff, for example, if a Royal Flush of any suit is dealt to the player or a superior ranked hand to a stated hand, e.g., three Jacks of any suit, or the casino can determine, by advising the players before the deal, that a certain specific three dealt cards constitute the Jackpot winning hand, e.g., the two Black Aces, Clubs and Spades, and the Ace of Hearts. The Jackpot bet is separately collected and paid off from the mandatory bet of 3s or better.

After the player's determine and place their wagers and place the tokens and chips on the betting/wagering areas, 22*a* and either 22*b* or 22*c* are mandatory bets whereas 22*d* and/or 22*e* are optional bets, the dealer deals three cards to each player and then three to himself. This is indicated by box 46 in FIG. 2. The dealer then shows his cards, box 48 in FIG. 2, and the player's dealt hand, one player at a time or all are shown as well (box 50 of FIG. 2) before resolution of the bets (box 52 of FIG. 2).

The dealer then resolves each player's bet based on the player's three card hand in comparison to the dealer's hand and determines what payout is to be made to each player according to the amounts wagered by the player, whether the player has placed optional bets, the payoff schedule or table, and the Jackpot amount to be paid if the Jackpot hand is dealt to the player and the player has bet thereon.

If the player's hand exceeds, in rank the dealer's three card stud poker hand, and if the player has bet on the player, betting area 22*c* (not the dealer 22*b*) then the player is provided with, in the preferred embodiment, a number of chips or tokens equal to the number bet thereon by the player. The player can remove his winnings and the original bet or continue to play by placing new mandatory and optional wagers. If the player's hand does not exceed the dealer's hand and the player has bet on the player 22*c* (not on the dealer 22*b*) then the player's wager is collected by the dealer. The player can leave the table or play a new game by placing a new set of mandatory wagers and optional wagers. If the player's hand exceeds the dealer's and the player has bet on the dealer 22*b* (not on the player, 22*c*), then the player loses the wager and the dealer collects the wager. Again, the player can leave the table or play another game by placing a new set of mandatory wagers and optional wagers. If the player's hand is less than the ranking of the dealer's hand and yet the player has bet on the dealer 22*b* (not on the player, 22*c*), then the player has won his wager and the dealer will "pay off," i.e., return the original wager and a fixed number of tokens or chips depending on the amount wagered. If the casino determines this outcome to warrant "even money" then the casino returns, along with the original wager, a number of tokens or chips equal in amount to the original wager, as winnings. Again, the player can leave the table or play another hand, placing a new set of mandatory wagers and optional wagers, if desired. It is currently contemplated that the minimum wager for a player or dealer bet, bet areas 22*c* and 22*b,* for example, be $5. However, for a player to receive $5 in winnings on a dealer bet, bet area 22*b,* the player must wager at least $6. Thus a $6 wager on the dealer will return the original $6 and a $5 winning. The amount of any one wager is independent of the other amounts wagered, within the prescribed minimums and maximums set by the casino and the returns for each amount wagered.

In the preferred embodiment, a tie of hands dealt to the dealer and player will result in the casino winning the dealer/player bet, whether the player has bet in area 22*b* or 22*c,* on dealer or player. However, if the player has placed an optional bet on the "Tie-Bet", bet area 22*e,* and a tie hand is dealt to dealer and player, i.e., the ranking of 3 card poker hands is identical as between that player and the dealer, then the dealer pays off on the tie bet (where otherwise a tie deal is a loss or at best a "push" to the player of his bet). A bet on the Tie Bet, bet area 22*e* and the dealing to that player and the dealer of identically ranked 3 card poker hands, pays the player according to a predetermined multiple of the amount wagered. According to the preferred embodiment of the invention, a tie bet, if a tie results between player and dealer's three card poker hand, results in a 7:1 payoff. If a tie-bet is bet and the hands are not an exact tie, then the dealer collects the Tie-bet from bet area 22*e.* If there is a tie of three card poker hands between player and dealer but the player has not placed a bet on bet area 22*e,* the player loses the bet.

After the dealer/player 22*b* or 22*c* and tie bets 22*e* are considered, compared and resolved, the dealer needs to determine and resolve the 3s or better bet, i.e., the amount bet by the player in bet area 22*a.* Here, the dealer does not compare the player's hand to the dealer's hand, but only compares the player's hand to a ranking of three card stud poker hands. In the preferred embodiment, a pair of 3s are the minimum ranking for the player to win this bet. Of course the 3s or better can be set at 2s or better, tens or better, a pair of Kings or better, an Ace high, or any ranking of a three card stud poker hand. The minimum ranking and payoff can be adjusted by the casino and should be posted on the felt surface. If the player's hand meets or exceeds the set minimum ranking for the 3s or better bet, a mandatory bet placed in bet area 22*a,* the dealer pays according to the set scale, independent of whether the player placed his or her bet on the player or the dealer, 22*c* or 22*b.* If the player's hand does not meet or exceed the set minimum ranking for the bet area 22*a,* in the preferred embodiment—a pair of 3s or better, the dealer collects the wager and the player is then free to leave the table or place new mandatory and optional wagers. If the player's hand equals or exceeds the minimum set ranking for the bet area 22*a,* for example, a pair of 3s or better, the dealer pays the player in proportion to the amount wagered by the player on that bet area and consistent with the following schedule:

A typical payoff table for bet area 22*a* or the 3s or better wager would be as follows:

| Ranking | Payoff (Multiple of Amount Wagered) |
|---|---|
| Pair of Threes or Better | 1-1 |
| Flush (Same Suit) | 5-1 |
| Straight (Different Suits) | 7-1 |
| Three of a Kind | 30-1 |
| Straight Flush | 40-1 |
| Royal Flush (J, Q and K or Q, K and Ace) | 60-1 |

Thus the mandatory bets (bet areas (22*c* or 22*b*) and 22*a*) are easily first resolved and paid or collected by the dealer, along with the optional Tie Bet (22*e*), if any was placed.

The dealer needs to also determine and resolve the Jackpot bet, bet area 22*d,* to the extent that any player has placed such a bet. If the bet has been made, by placing the minimum token, chip or money on bet area 22*d* and the dealt hand to the player is not either the predetermined rank or better than that established by the casino for the Jackpot or not equal to the exact hand required for the Jackpot hand, the dealer simply collects the player's wager from the Jackpot area 22*d.* If the player has bet the Jackpot by placing a bet on bet area 22*d* (the Dingo® bet) and the player's hand equals or exceeds the set ranking for that bet or is identical to the three cards established by the casino for the Jackpot bet, then the Jackpot is payed off by the Dealer. This can be a multiple of the amount wagered, a predetermined amount of dollars, e.g., $25,000., or an increasing amount set by the number of Jackpot bets since the last winner (less a house charge), etc. According to the preferred embodiment of the present invention the Jackpot bet will return 1000:1 when the player's hand exactly matches the two black Aces (Club and Spades) and the Ace of Hearts. Of course, the casino can set the Jackpot bet at different odds or payoffs and can also set, for example, a payoff for merely meeting or exceeding a predetermined hand of three cards, e.g., three 8s or better, or three of a particular face card. Again, however, to reduce redundancy of betting and to ensure that the game is interesting, it is contemplated that the Jackpot bet, bet area 22*d,* be an optional bet for the possibility of obtaining three specific cards of the 52 playing card deck, which, according to the preferred embodiment, is intended to be the Black Aces (Clubs and Spades) and the Ace of Hearts. Of course, if the player's hand meets or exceeds the set ranking required for the Jackpot payoff or has the exact established cards for the Jackpot or betting area 22*d* and, yet, the player has not placed an optional bet thereon, he/she will not recover the Jackpot payoff (although the player may obtain a multiple of his bet based on the schedule for the 3s or better, betting area 22*a*). The Jackpot bet is only paid when the player has made an optional bet thereon, by placing a token or chips on bet area 22*d.* The Jackpot bet is paid independently of the Player/Dealer bets, 22*c* and 22*b,* the Tie Bet, 22*e,* and the 3s or better bet, 22*a.*

Dealing and Playing Procedures

1. Before proceeding with each hand, the dealer asks the players to place their bets, namely, the two mandatory bets on 22*a* and either 22*b* or 22*c.* This is the bet that the player's 3 card poker hand will contain 3s or better (bet area 22*a*) and a bet on either the player (22*c*) or the dealer (22*b*) having the superior 3 card poker hand. The players place their tokens, equal to or more than the minimums, less than the maximums, as set by the casino, on the designated areas and also determine the desirability of placing optional bets on the possibility of a Tie Bet (bet area 22*e*) and/or the possibility of a Jackpot hand being dealt to the player (placing a token/chip on the Jackpot Bet, bet area 22*d,* (a Dingo® Bet)). The players may place either the mandatory game entry wagers ("Threes or Better" and "Dealer Bet" or "Player Bet") and the optional wagers ("Jackpot/Dingo Bonus and/or "Tie Bet") on the table—the order of placement does not matter. It also does not matter which of the Players places his mandatory or optional wagers first or in which order. What is important is that all wagers be clearly placed before any of the cards are dealt or seen.
2. After all wagers are placed by the participating players, the dealer takes cards from the stack of shuffled cards, one deck or more of 52 cards, and deals a first card to each player and the dealer, a second card to all and then a third and final card. Of course, the dealer can, if this is the chosen method of the casino, deal three cards successively to each of the players and then the last three to the dealer. Any acceptable manner of shuffling and dealing is contemplated so long as fairness is maintained.

3. The dealer begins viewing cards and resolving bets with the first player on his left. The dealer must not allow players to reach out and retrieve their own bets. If a player does this, the dealer should politely ask him not to do so in the future. Only the dealer can return bets or collect bets to or from a player.
4. Each player, in turn, turns over his cards and the dealer, in turn, turns over his three cards. Here, again, the order is not important, only that the dealer reveal his cards before the dealer/player bet is resolved (bet areas 22*b* and 22*c*).
5. Starting with the player on the dealer's left, the dealer determines and resolves the wagers of the players, one after the other. First the dealer determines and resolves the player vs. dealer bet, i.e., 22*c* and 22*b*. This bet is resolved dependent upon which of the two dealt hands is a higher ranked three card poker hand and how the player has bet, whether on 22*c* or 22*b*. The casino's rules can be set such that a tie can either be a win for the dealer or a "push", neither win nor loss to player and dealer. A tie can also be set as a win for the player, although this is rarely set by casinos. Then, the optional tie bet, area 22*e*, if wagered, is resolved. If no bet thereon, even in the event of an actual tie, the dealer does not pay the player. However, if the player has placed a bet on bet area 22*e* and the 3 card poker hands are exact ranks of one another, then the dealer pays the player based on a multiple of the tie bet. This, consistent with the preferred embodiment, is intended to be a payoff of 7:1. If a tie occurs but no bet was placed by the player on the optional Tie Bet, bet area 22*e*, then no payout is made for that bet. Then, the dealer determines and resolves the 3s or better bet, i.e., bet area 22*a*. If the player's hand does not equal or exceed that ranking then the player's bet is collected. If the player's hand equals or exceeds that minimum and preset ranking then the dealer pays the player, consistent with the schedule for bet area 22*a*. The bet area 22*a* is paid to the player even if the player, for that hand, has bet on the dealer by placing a bet on bet area 22*b*. They are independent bets, 22*a* and (22*b* or 22*c*). Similarly, even if the player bets on the dealer with a bet on bet area 22*b*, the dealer only pays the player for wagers on 22*a* if the player's hand, not the dealers, equals or exceeds the set minimum ranking, a pair of 3s or better. There is no payment for 3s or better for the dealer's hand even if the player has bet on the dealer's hand beating the rank of the player's.

Finally, the dealer determines and resolves the optional Jackpot bet, betting area 22*d*, of each player, if it was wagered. If there is a bet thereon and the player's dealt hand is not the hand established by the casino as the Jackpot bet, then the player's bet is collected. If the player has placed a bet on bet area 22*d* and the dealt hand to the player is the Jackpot bet, then the dealer pays the player the Jackpot amount, a preset amount; an increasing amount between Jackpot winners; or a multiple of the bet amount. If there is no bet on bet area 22*e* and a Jackpot hand is dealt to the player, no payoff results as the player did not risk a bet on that possibility. Of course, whether or not a wager is on bet area 22*d*, if the dealer's dealt hand is the Jackpot hand, no payoff results to the player, even if the player has bet on bet area 22*b*, on the dealer. That bet, 22*b* or 22*c* is only for a comparison of the dealer's 3 card poker hand to the player's and is not called into play for the 22*a*, pair of 3s or better resolution, or the Jackpot resolution, bet area 22*d*.

Once a player's hand is resolved and wagers paid and/or collected, the dealer collects that player's cards and places them face down in the discard rack. The dealer then moves on to the next player from his left and follows the same procedures for determination and resolving the player's wagers.

When the dealer finishes with the last player (the first player on his right) the hands are over and each player can take his chips or tokens and leave the game or continue with a new set of cards after mandatory wagers are placed (bet area 22*a* and bet area 22*b* or bet area 22*c*) with or without optional wagers (tie bet, bet area 22*e* and/or a Jackpot bet, bet area 22*d*). A new set of 3 cards are then dealt to each participating player (with the mandatory bets first on the table and within betting areas and the optional wagers, if any) and the dealer.

The wagering game of the present invention might be played live with a dealer at one or more gaming tables in one or more casinos, or in casinos, homes and other locations in interactive electronic or video form with automatic coin or betting symbols, receptacles and payout capability, wherein appropriate symbols for cards, wagers or score keeping would be displayed electronically. Furthermore, the present invention may be embodied in other specific forms without departing from the essential attributes thereof. It is desired that the embodiments described above be considered in all respects as illustrative, not restrictive, reference being made to the appended claims to indicate the scope of the invention.

What is claimed is:

1. A method for playing and wagering on a playing card poker game between a casino represented by a dealer and one or more players comprising:

each player risking a first mandatory wager to become a participant in the playing card poker game and on the possibility that a poker hand dealt to the player meets or exceeds a predetermined minimum ranking of poker hands and each player risking a second mandatory wager on whether a poker hand dealt to the player exceeds or is less in ranking than a poker hand dealt to the dealer;

dealing a poker hand of playing cards to each player and to the dealer; and resolving each player's first and second mandatory wagers based on said player's poker hand and said dealer's poker hand, as follows:

i) if the player's poker hand does not meet or exceed the predetermined minimum ranking of poker hands, the player forfeits said first mandatory wager; or ii) if the player's poker hand meets or exceeds the predetermined minimum ranking of poker hands, the player is paid by said dealer based on a predetermined schedule of ranked poker hands proportional to said first mandatory wager; and iii) if the player's poker hand exceeds the dealer's poker hand and the player's second mandatory wager is consistent with that result, paying the player proportional to said second mandatory wager, but if the player's second mandatory wager is inconsistent with that result, the dealer collecting the second mandatory wager; or iv) if the player's poker hand does not exceed the dealer's poker hand and the player's second mandatory wager is consistent with that result, paying the player proportional to said second mandatory wager, but if the player's second mandatory wager is inconsistent with that result, the dealer collecting said second mandatory wager.

2. A method as claimed in claim 1 wherein said playing card poker game uses 3-cards.

3. A method as claimed in claim 2 wherein said three cards are maintained as in stud poker, i.e., without replacement cards being provided to either player or dealer.

4. A method as claimed in claim 1 further comprising providing an opportunity for said player to place a first optional wager on the possibility that a comparison of said player's ranked poker hand and said dealer's ranked poker hand results in a tie determination and paying said player a Tie-Bet payoff proportional to said first optional wager if a tie determination results from said deal of said poker hands of playing cards to said player and said dealer but only if said player has wagered a first optional wager and collecting said first optional wager, if said player has wagered a first optional wager, if a no-tie determination results from said deal of said poker hands of playing cards to said player and said dealer.

5. A method as claimed in claim 4 wherein said Tie-Bet payoff proportional to said first optional wager is 7:1.

6. A method as claimed in claim 1 wherein said predetermined minimum ranking of poker hands is a pair of 3s.

7. A method as claimed in claim 1 wherein said predetermined schedule of ranked poker hands proportional to said first mandatory wager is as follows:

| Ranking | Payoff (Multiple of Amount Wagered) |
|---|---|
| Pairs | 1-1 |
| Flush (Same Suit) | 5-1 |

-continued

| Ranking | Payoff (Multiple of Amount Wagered) |
|---|---|
| Straight (Different Suits) | 7-1 |
| Three of a Kind | 30-1 |
| Straight Flush | 40-1 |
| Royal Flush (J, Q and K or Q, K and Ace) | 60-1 |

8. A method as claimed in claim 7 wherein said Pairs is a Pair of 3s.

9. A method as claimed in claim 1 further comprising providing the player with the opportunity to place a second optional bet on the possibility that said poker hand dealt to said player is three precise cards of a standard 52 card playing card deck and paying said player a Jackpot if the player's poker hand is said precise three cards and collecting said second optional bet if said player's poker hand is not said precise three cards.

10. A method as claimed in claim 9 wherein said Jackpot is proportional to said second optional bet.

11. A method as claimed in claim 9 wherein said Jackpot is based on a predetermined amount.

12. A method as claimed in claim 11 wherein said predetermined amount is $25,000. or more.

13. A method as claimed in claim 9 wherein said Jackpot is based on the number of second optional bets made by players since the last payment of a Jackpot to a player.

14. A method as claimed in claim 9 wherein said three precise cards is the Ace of Clubs, Ace of Spades, and either the Ace of Hearts or Diamonds.

* * * * *